US007874931B2

(12) United States Patent
Liao

(10) Patent No.: US 7,874,931 B2
(45) Date of Patent: Jan. 25, 2011

(54) INFLATABLE TYPE GOLF SWING TRAINING APPARATUS

(76) Inventor: Lihua Liao, No. 12, West Road of Zhengfu Street, Changping District, Beijing (CN) 102200

( * ) Notice: Subject to any disclaimer, the term of this patent is extended or adjusted under 35 U.S.C. 154(b) by 0 days.

(21) Appl. No.: 12/519,134

(22) PCT Filed: Dec. 12, 2006

(86) PCT No.: PCT/CN2006/003373

§ 371 (c)(1),
(2), (4) Date: Jun. 12, 2009

(87) PCT Pub. No.: WO2008/071031

PCT Pub. Date: Jun. 19, 2008

(65) Prior Publication Data

US 2010/0087268 A1 Apr. 8, 2010

(51) Int. Cl.
*A63B 69/36* (2006.01)

(52) U.S. Cl. ..... 473/259; 473/257

(58) Field of Classification Search ..... 473/257–261, 473/266

See application file for complete search history.

(56) References Cited

U.S. PATENT DOCUMENTS

| | | | |
|---|---|---|---|
| 5,026,065 | A | 6/1991 | Bellagamba |
| 5,429,367 | A | 7/1995 | Amos |
| 5,816,932 | A | 10/1998 | Alexander |
| 2005/0197212 | A1 | 9/2005 | Turcot |

FOREIGN PATENT DOCUMENTS

| | | |
|---|---|---|
| CN | 1430529 | 7/2003 |

*Primary Examiner*—Nini Legesse
(74) *Attorney, Agent, or Firm*—Greer, Burns & Crain, Ltd.

(57) ABSTRACT

An inflatable type golf swing training apparatus, which comprises an inflatable track guide and adjustable struts. The inflatable track guide had a radian of an swing track and is made by an enclosed capsule which is hollow and inflatable and is made of elastic material. The adjustable struts includes two front adjustable struts which are provided at the lower part of the inflatable track guide and used for adjusting the height and angle thereof, and two rear adjustable struts which are provided at the middle part of the inflatable track guide and used for adjusting the angle of the track guide plane with respect to the horizontal plane.

10 Claims, 5 Drawing Sheets

INFLATABLE TYPE GOLF SWING TRAINING APPARATUS

FIELD OF THE INVENTION

The present invention relates to a sports training apparatus, particularly to an inflatable type golf swing training apparatus.

BACKGROUND OF THE INVENTION

Swing is a key basic skill in golf sport. Whether the swing stance is proper or not directly impacts on the flying trajectory of the golf ball, and consequently affects the result. All golf players have the experience that, as long as the stance is proper, the result will not be too bad. However, at the beginning stage, since the players do not have a fixed proper swing action, together with various factors during the practice, their swing stances tend to be changed. Therefore, how to fix a proper swing stance is a key factor for the players to improve their golf result.

At present, there are a variety of methods and apparatus for golf swing training, which include indoor and outdoor training apparatus, such as a golf ball training apparatus in an invention patent application (application No. CN 96193622.3), and various golf swing training apparatus, such as golf swing trainers (patent application No. CN 97230152.6 and CN00243726.0). All inventions in these various applications require the golf players themselves to be trained for a long time and to feel the sense of proper swing so as to fix a proper stance and keep it as a habit. However, it will take too much time for the golf player. Moreover, if ordinary people want to practice golf swing, they have no choice but either practicing at home by purchasing a training apparatus or practicing on a golf course. Because of expensive cost of the training apparatus and high fees for the golf course, the popularity of golf sport in ordinary people is limited.

Particularly, it is important for a player to fix down his/her swing stance in a possibly shortest time so as to make the swing stance undeformed when entering into the golf course, and becoming a golf player and even a golf competitor having excellent result. By using the current training apparatus, it will take a long time to achieve those.

Chinese utility model patent CN2664729 discloses a golf swing training apparatus, which comprises: a base frame; a curved guide, disposed on the base frame, a user space being defined behind the curved guide for a practicer standing and swinging therein, wherein the track of the curved guide is located on an identical plane that faces the user space and is tilted with its top inclining backwardly; a linear guide, disposed on the curved guide in such a manner that the linear guide can slide along the curved guide, wherein the longitudinal axis of the linear guide is parallel to the plane where the curved guide located, and the direction, along which the linear guide extends linearly, generally corresponding to the direction that extended outwardly from the center of the curved guide; a carriage, disposed on the linear guide in such a manner that the carriage can slide along the linear guide, and extended a distance backwardly from the linear guide; and a simulated club, with one end pivoted to the back end of the carriage and the other end for user gripping.

Chinese utility model patent CN2638793 discloses a swing training apparatus, which comprises: a camber guide, the guide length of which is designed according to the maximum swing amplitude of the club head when the user swings; and a securing seat that secures the camber guide into a predetermined using angle, which is disposed at the bottom of the camber guide. This patent still can not effectively fix the swing stance of the practicer.

U.S. Pat. No. 5,595,545 discloses a track training apparatus, which comprises a tilted guide, a golf club, and a base frame.

The inventor has filed a PCT application on 2005 (International Application No. PCT/CN2005/002147) on a golf swing training track apparatus, which is also expensive in manufacturing cost, inconvenient to carry, and unsafe to use.

As summed up, the above-mentioned prior art technologies are complex in structures, high in manufacturing cost, and inconvenient to carry. Especially, their guides are all made of metal material, which are not safe to use and easy to hurt the practicers during the training.

SUMMARY OF THE INVENTION

An objective of the present invention is to provide an inflatable type golf swing training apparatus, which can fix the swing stance in a possibly shortest time. With said apparatus, the swing training can proceed at anytime and anywhere. More importantly, the inflatable type apparatus is low in manufacturing cost, easy to carry, and safe to use. The golf practicers can practice swing along a predetermined swing guide.

In order to achieve the above-mentioned objective, the present invention discloses an inflatable type golf swing training apparatus, which comprises an inflatable track guide, front adjustable struts, and rear adjustable struts.

The inflatable track guide has a guide radian corresponding to a swing track, and is made by enclosing a hollow and inflatable capsule made of elastic material.

Two front adjustable struts are disposed at the lower part of the inflatable track guide for adjusting the height and the angle of the inflatable track guide.

Two rear adjustable struts are disposed in the middle part of the inflatable track guide for adjusting the angle of the plane of the inflatable track guide with respect to the horizontal plane.

The guide radian of the inflatable track guide can be chosen depending on various demands of the practicers.

Protuberances are disposed on the inflatable track guide, through which the front adjustable struts and the rear adjustable struts are coupled to the inflatable track guide.

The front and the rear adjustable struts are of telescopic structures and are made of hard plastic-steel material.

The tilt angle of the plane of the inflatable track guide with respect to the horizontal plane is larger than 45 degrees and less than 90 degrees.

The inflatable track guide is made of magnetic plastic material.

The outer surface of the inflatable track guide is coated with metal mesh, which is further coated with a layer of wear-resistant glossy material;

Both the front adjustable struts and the rear adjustable struts can be adjusted in spiral or telescopic way, for adjusting the tilt angle of the track guide.

Each of the front adjustable struts and the rear adjustable struts is provided with a rubber sucker or a fixed platform at a portion which contacts with the ground.

The inflatable type golf swing training apparatus according to the present invention allows the golf practicer to swing along the established or adjusted guide, and making his/her swing stance steady in a possibly shortest time. The swing training can be carried out at anytime and anywhere, without a special training course. In addition, this invention has low manufacturing cost and simple manufacturing process, and is easy to carry and safe to use. The implementation of this invention will definitely speed up the popularity of golf sport.

Figure 1:
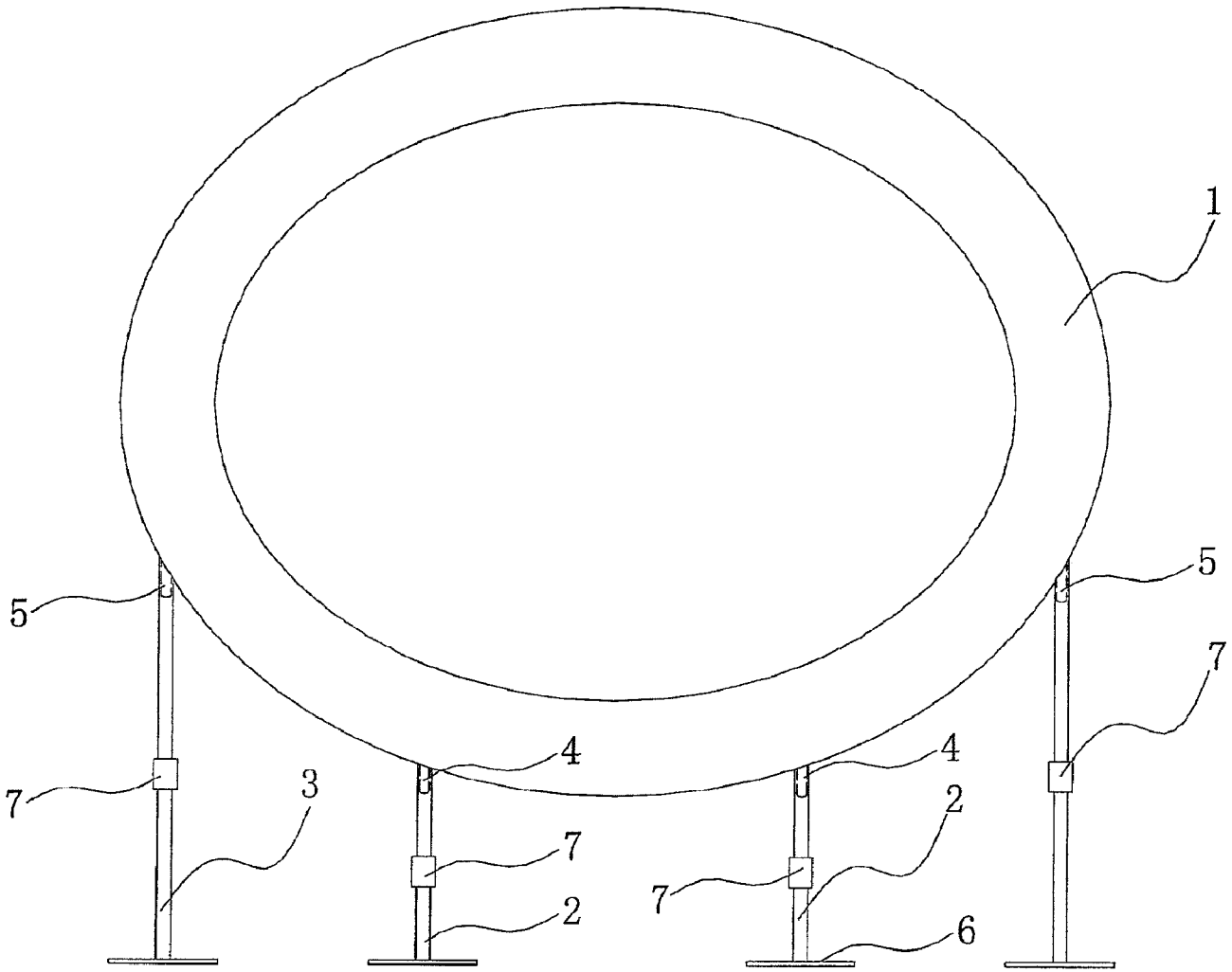
FIG. 1 is a front elevation view of an exemplary embodiment of the present invention.

Reference signs in these drawings comprises:

1: track guide
2: front adjustable strut
3: rear adjustable stmt
4: protuberance
5: protuberance
6: fixed platform
7: adjustment screw
8: metal mesh
9: plastic material layer
10: magnetic material layer

DETAILED DESCRIPTION OF THE PREFERRED EMBODIMENT

As well known, the golf ball can fly and then fall off along a trajectory by hitting it through properly swing the club. The magnitude and the direction of the swing force and the angle, at which the golf ball contacts with the club head, determine the flying trajectory of the golf ball. Without the influence of other factors, such as wind power, if the magnitude and the direction of the swing force can be fixed, the angle and the distance of the flying trajectory of the golf ball will also be fixed. And the result of the golf player will be thus satisfied.

The inflatable type golf swing training apparatus disclosed by the present invention fixes the user's swing stance based on the principle that track is restricted by the guide, and correcting the improper swing stance, which is greatly suitable for the practicer to practice the swing stance.

The inflatable type golf swing training apparatus disclosed by the present invention adopts an inflatable type guide, which is adjustable in height and tilt angle, seeing FIG. 1. The practicer can adjust the height and the angle according to his/her physical features, which makes this apparatus suitable for family purchase and using by multiple people. When practicing, each family member can adjust the angle of the guide plane and the height of the guide according to his/her own condition. After adjustment, the guide can be fixed so as to on one hand maintain the whole apparatus stable when the practicer is practicing and on the other hand keep the swing stance of the practicer fixed, to ensure the consistency of the action and properness of the stance, and thus taking the effect on fixing the proper swing stance.

Figure 2:
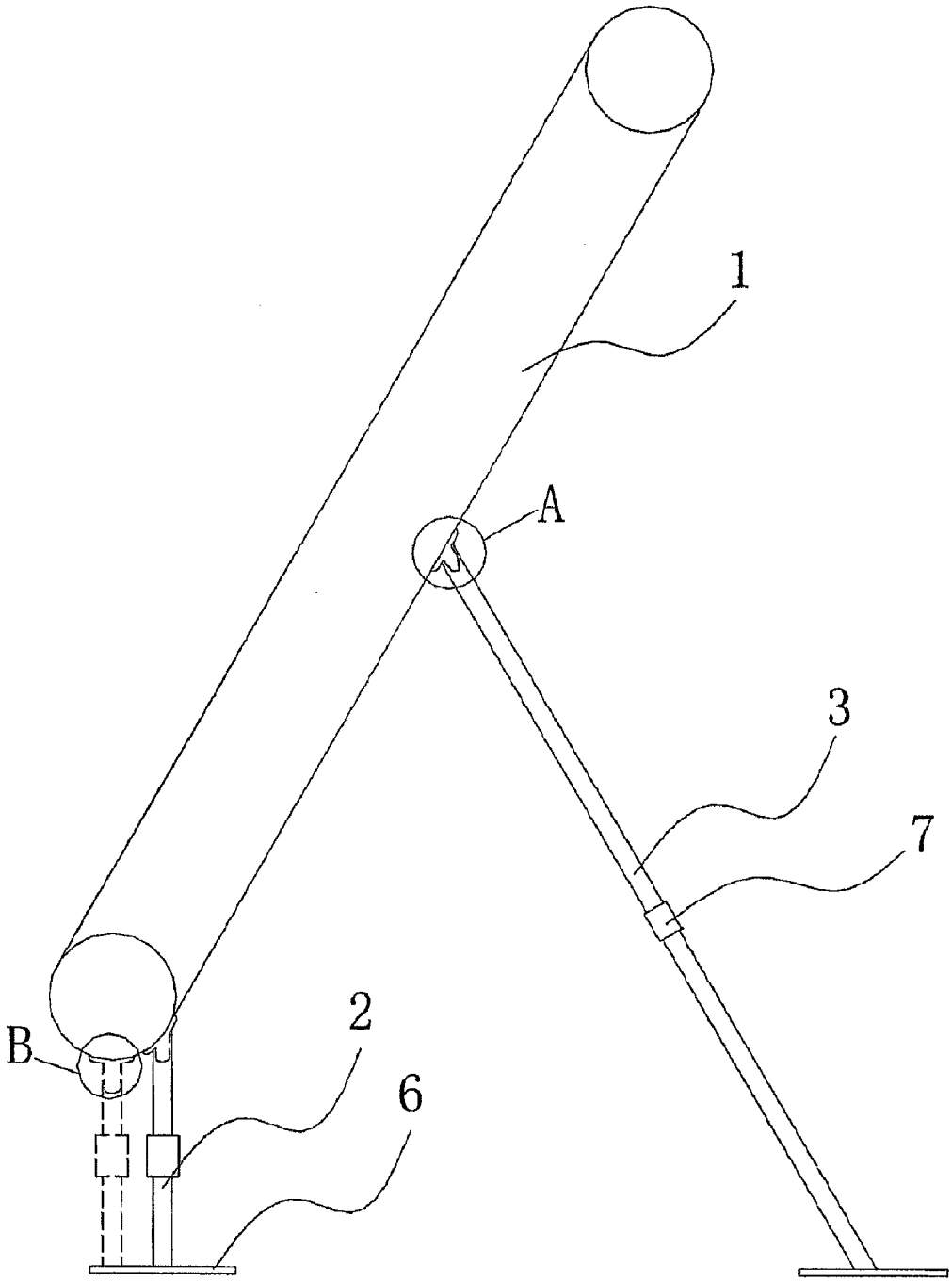
FIG. 2 is a side cross sectional view of FIG. 1.

The adjustable inflatable type golf swing training apparatus mainly comprises: the inflatable track guide 1, front adjustable struts 2 and rear adjustable struts 3, seeing FIG. 1 and FIG. 2, which is a side view of FIG. 1.

The inflatable track guide 1 is a capsule having a closed track, which is formed by enclosing a hollow cylinder that has a diameter of about 200 mm and is made of wear-resistant elastic plastic material. The capsule has a cross section, which can be round or elliptical or irregularly oblate shaped. The guide radian of the closed track guide can be designed in accordance with the track corresponding to the proper swing stance, which can be an ellipse, for example, having a vertical inner diameter of about 1500 mm and a horizontal inner diameter of about 1700 mm.

Figure 5:
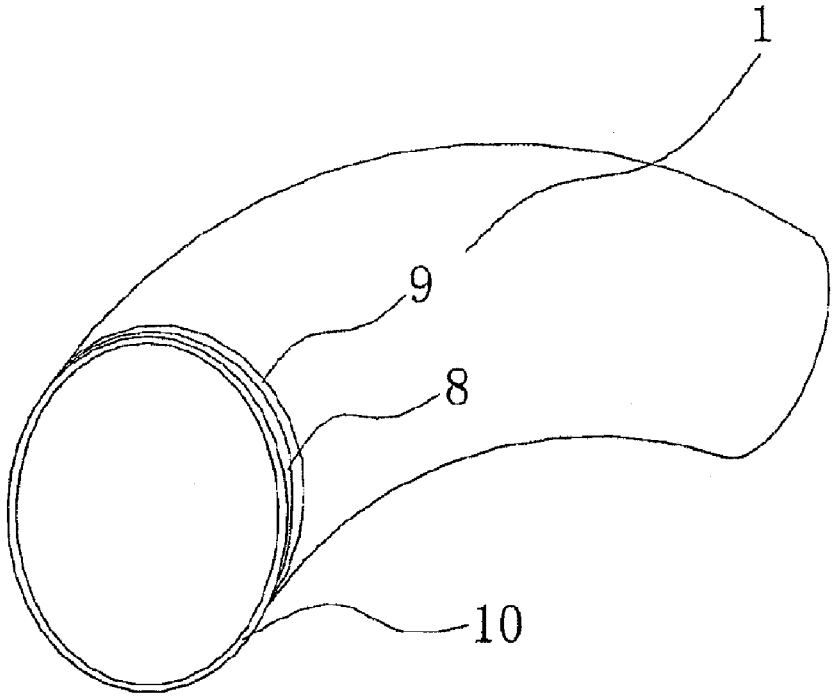
FIG. 5 is a cross sectional view of the track guide of the present invention.

Two front adjustable struts 2 are vertically arranged at the lower part of the inflatable track guide 1. The height is of about 1200 mm. Both of the front adjustable struts 2 are hollow struts, which can be made of stainless steel or plastic materials, and being fastened to the inflatable track guide 1 through protuberances 4 at the lower part of the guide. The front adjustable struts 2 can be disposed at the side lower part of the inflatable track guide 1, or can just beneath the inflatable track guide 1 (dashed portion). FIG. 2 shows said two possible embodiments, wherein protuberances 5 in part B are shown in FIG. 5.

Figure 3:
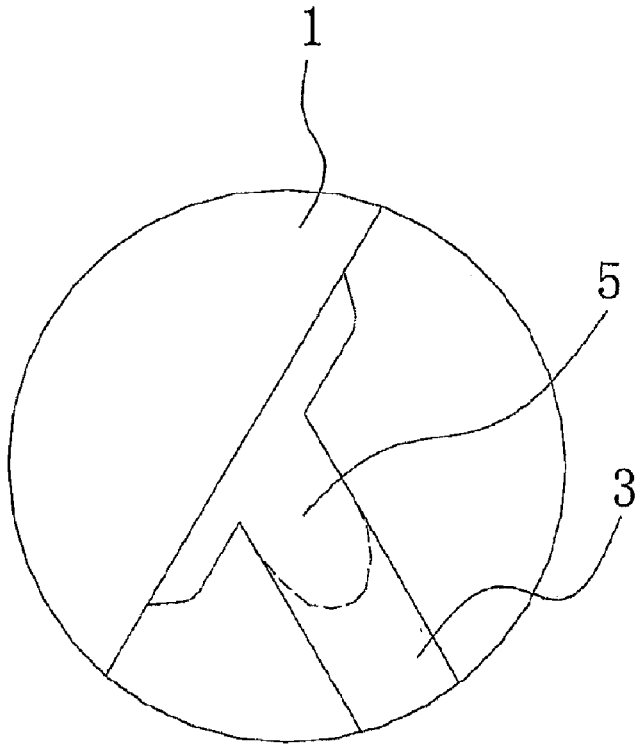
FIG. 3 is a view of the protuberance part A of FIG. 1.
Figure 4:
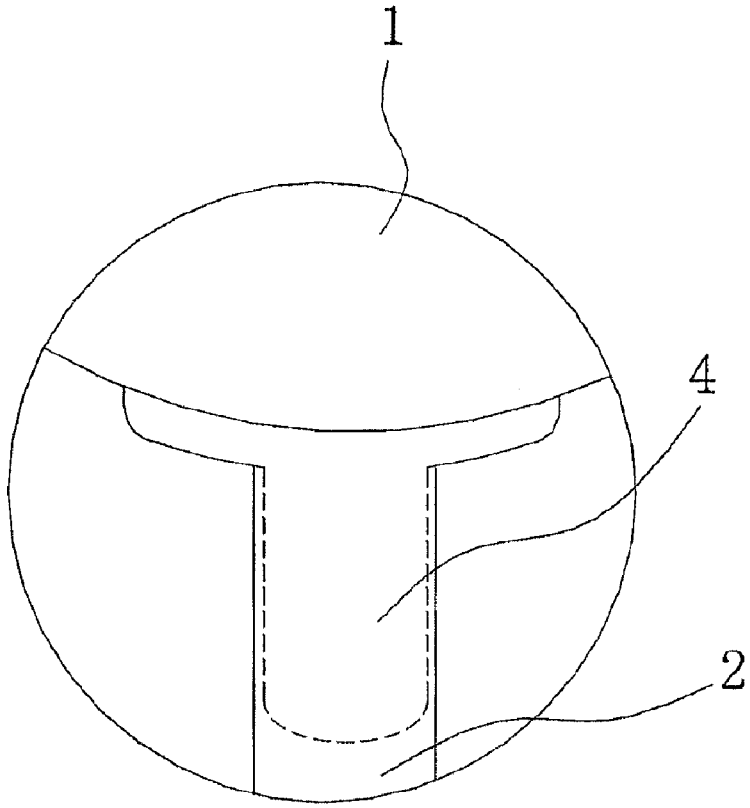
FIG. 4 is a view of the protuberance part B of FIG. 1.

The protuberances 4 at the lower part of the guide can be attached thereto through rubber suckers, or being directly attached to the guide, or being designed prior to manufacturing the guide. The outer diameter of the protuberance 4 is consistent with the inner diameter of the hollow front adjustable stmt 2, so that the front adjustable stmt 2 can be fitly set to the protuberance 4. Similarly, two rear adjustable struts 2 are arranged at the middle part of the guide 1 for adjusting the tilt angle of the plane of the guide 1 with respect to the horizontal plane. The two rear adjustable struts 2 are in the same structures as those of the front adjustable struts 3, except that the length of which is longer than the front adjustable struts 3. The rear adjustable struts 3 are at an angle less than 90 degree with respect to the horizontal plane, and can be perpendicular to the plane of the guide 1. Similarly, the two rear adjustable struts are coupled to the guide 1 through protuberances 5. The protuberances 5 on the guide have the same structures and effect as the protuberances 4. The protuberance parts A and B of the guide can be seen in FIG. 3 and FIG. 4. The front and the rear adjustable struts can be adjusted in a spiral or a telescopic way for adjusting the height of the track guide and the tilt angle of the plane of the same. The two front adjustable struts are used for adjusting mainly the height and the tilt angle as well.

Each of the front adjustable struts 3 and the rear adjustable struts 2 can be provided with a rubber sucker or a fixed platform 6 at the portion which contacts with the ground, for fastening firmly the front adjustable struts 3 and the rear adjustable struts 2 on the ground respectively.

The guide radian can be designed according to the track of proper swing.

For example, the physical characteristics of a person can be classified into with N types according to the stature, weight, figure, waistline, and etc. M1 categories of standard guide radians, M2 categories of special guide radians, and L categories of guide radians of the well-known golf athletes can be included. The practicers can choose the guide radian(s) suitable for themselves for training according to their own condition.

The two front adjustable struts 3 and the two rear adjustable struts 2 are of telescopic structures and are made of stainless steel or hard plastic-steel materials. During the adjustment the height of the struts, they can be fixed by the adjustment screws 7 thereon, allowing the plane where the inflatable track guide 1 located being tilted with respect to the horizontal plane in accordance with the statures and so on of the different practicers, i.e., being in a proper height and tilt angle according to the habit of the practicer. Generally, the tilt angle is larger than 45 degrees and less than 90 degrees with respect to the horizontal plane.

During the manufacturing of the inflatable type track guide, a magnetic material layer 10 can be used to make said track guide. Alternatively, metal mesh 8 can be coated over the outer surface of the track guide, while a wear-resistant and glossy plastic material layer 9 can be coated over the metal mesh 8, seeing FIG. 5. A magnet or magnetic material can be disposed on the corresponding portion of the inner tube of the golf club, which will be contacts with the guide (not shown). When the golf club is swung along the track guide, the golf club of the practicer can be attracted to the track guide due to the magnetic effect.

When using the present invention, the track guide is pumped up firstly with an inflator or a pump. When the gas in the track guide has reached a determined pressure, the user can stand into the circle formed by the track guide, holding the grip of the club and swinging. Because of the restriction of the guide of proper track, the practicer can only act along the predetermined proper track, which ensures the practicer's swing stance proper. Besides, with the attraction effect of the magnet, the practicer can save more labor. Moreover, since the whole track guide is made of plastic material, the user doesn't have to worry about being hurt by the metal components during the practice. After the training, the training apparatus can be conveniently placed into a bag by disassembling the adjustable struts and exhausting the gas in the guide, which is small in size and easy to carry.

The present invention can also be improved or deformed for training any other sport which needs proper stance, such as training discus athletes, table tennis athletes or the like. All of these improvements should be included in the scope of the claims of this invention.

INDUSTRIAL APPLICATION

The inflatable type golf swing training apparatus of the present invention allows the golf sport practicers to practice swing along the prearranged swing guide and helps them to fix their swing stance in a possibly shortest time. The swing training can be carried at anytime and anywhere, without a specific training course. In addition, the present invention has low manufacturing cost and simple manufacturing process. The inflatable type apparatus has a small size after packed, and easy to carry and safe to use. The implementation of the present invention will definitely speed up the popularity of golf sport.

What is claimed is:

1. An inflatable type golf swing training apparatus, comprising: an inflatable track guide, and adjustable struts that allow angle adjustment and height adjustment of the inflatable track guide, wherein the inflatable track guide has a guide radian corresponding to a swing track and is made by enclosing a hollow and inflatable capsule made of elastic material.

2. The inflatable type golf swing training apparatus of claim 1, wherein the adjustable struts includes two front adjustable struts, which are disposed at the lower part of the inflatable track guide and used for adjusting the height and the angle of the inflatable track guide, and two rear adjustable struts, which disposed at the middle part of the inflatable track guide for adjusting the angle of the track guide plane with respect to the horizontal plane.

3. The inflatable type golf swing training apparatus of claim 2, wherein the front adjustable struts and the rear adjustable struts are of telescopic structures and are made of hard plastic-steel material, the front adjustable struts being perpendicular to the horizontal plane while the rear struts being tilted to the horizontal plane at an angle.

4. The inflatable type golf swing training apparatus of claim 3, wherein the tilt angle of the plane of the inflatable track guide with respect to the horizontal is larger than 45 degrees and less than 90 degrees.

5. The inflatable type golf swing training apparatus of claim 1, wherein the guide radian of the track guide can be chosen depending on various demands of the practicers.

6. The inflatable type golf swing training apparatus of claim 1, wherein protuberances are disposed on the inflatable track guide, through which the front adjustable struts and the rear adjustable struts are coupled to the inflatable track guide.

7. The inflatable type golf swing training apparatus of claim 1, wherein the inflatable track guide is made of magnetic plastic material.

8. The inflatable type golf swing training apparatus of claim 1, wherein an outer surface of the inflatable track guide is coated with metal mesh, which is further coated with a layer of wear-resistant glossy material.

9. The inflatable type golf swing training apparatus of claim 2, wherein both the front adjustable struts and the rear adjustable struts can be adjusted in a spiral or telescopic way.

10. The inflatable type golf swing training apparatus of claim 9, wherein each of the front adjustable struts and the rear adjustable struts is provided with a rubber sucker or a fixed platform at a portion which contacts with the ground.

* * * * *